US011440076B2

(12) United States Patent
Yuan et al.

(10) Patent No.: US 11,440,076 B2
(45) Date of Patent: Sep. 13, 2022

(54) DEVICE FOR SUPER CRYOGENIC FORMING OF METAL THIN-WALLED CURVED SURFACE PART

(71) Applicant: Dalian University of Technology, Dalian (CN)

(72) Inventors: Shijian Yuan, Dalian (CN); Xiaobo Fan, Dalian (CN)

(73) Assignee: Dalian University of Technology

( * ) Notice: Subject to any disclaimer, the term of this patent is extended or adjusted under 35 U.S.C. 154(b) by 0 days.

(21) Appl. No.: 17/474,752

(22) Filed: Sep. 14, 2021

(65) Prior Publication Data

US 2022/0080488 A1 Mar. 17, 2022

(30) Foreign Application Priority Data

Sep. 15, 2020 (CN) ..... 202010964727.7

(51) Int. Cl.
*B21D 37/16* (2006.01)
*B21D 22/20* (2006.01)

(52) U.S. Cl.
CPC ..... *B21D 37/16* (2013.01); *B21D 22/20* (2013.01)

(58) Field of Classification Search
CPC .... B21D 37/16; B21D 26/021; B21D 26/027; B21D 22/22; B30B 15/34
See application file for complete search history.

(56) References Cited

U.S. PATENT DOCUMENTS 5,941,110 A * 8/1999 Cao ..... B21B 37/00 72/21.4
2013/0104618 A1 5/2013 Daimaru
(Continued)

FOREIGN PATENT DOCUMENTS

CN 200995480 Y 12/2007
CN 203791436 U 8/2014
(Continued)

OTHER PUBLICATIONS

First Office Action for Chinese Application No. 202010964727.7 dated Mar. 17, 2021; 7 pages.
(Continued)

*Primary Examiner* — Debra M Sullivan
*Assistant Examiner* — Matthew Stephens
(74) *Attorney, Agent, or Firm* — Lerner, David, Littenberg, Krumholz & Mentlik, LLP

(57) ABSTRACT

The present disclosure provides a device for super cryogenic forming of a metal thin-walled curved surface part, including a super cryogenic medium conveying and pressurizing unit, a press, a die unit and a control system. A blank holder cylinder, a blank holder slide, a deep drawing cylinder and a deep drawing slide are disposed on the press. The die unit includes a male die, a blank holder and a female die. The super cryogenic medium conveying and pressurizing unit includes an autoboosting cryogenic container. A cryogenic channel in the blank holder, a cryogenic channel in the female die and a cavity of the female die are communicated with an outlet of the autoboosting cryogenic container by cryogenic pipes, respectively. A cryogenic pump is disposed on the cryogenic pipe between the cavity of the female die and the autoboosting cryogenic container.

5 Claims, 2 Drawing Sheets

(56) References Cited

U.S. PATENT DOCUMENTS

| | | | | |
|---|---|---|---|---|
| 2018/0001368 | A1* | 1/2018 | Otsuka | B21D 22/022 72/364 |
| 2019/0240716 | A1* | 8/2019 | Yuan | B21D 37/16 72/364 |
| 2020/0346271 | A1* | 11/2020 | Yuan | C22C 21/12 72/364 |

FOREIGN PATENT DOCUMENTS

| | | | | | |
|---|---|---|---|---|---|
| CN | 103402666 | B | * | 1/2016 | B30B 1/261 |
| CN | 105537362 | A | | 5/2016 | |
| CN | 106238551 | A | * | 12/2016 | B21D 26/021 |
| CN | 108326159 | A | | 7/2018 | |
| CN | 109500195 | A | | 3/2019 | |
| CN | 111940583 | A | * | 11/2020 | B21D 22/22 |
| CN | 112916700 | A | * | 6/2021 | B21D 22/02 |
| EP | 2578328 | B1 | | 3/2018 | |

OTHER PUBLICATIONS

Second Office Action for Chinese Application No. 202010964727.7 dated May 11, 2021; 8 pages.

* cited by examiner

DEVICE FOR SUPER CRYOGENIC FORMING OF METAL THIN-WALLED CURVED SURFACE PART

CROSS REFERENCE TO RELATED APPLICATION

This patent application claims the benefit and priority of Chinese Patent Application No. 202010964727.7 filed on Sep. 15, 2020, the disclosure of which is incorporated by reference herein in its entirety as part of the present application.

TECHNICAL FIELD

The present disclosure relates to the technical field of sheet metal forming, and in particular, to a device for super cryogenic forming of a metal thin-walled curved surface part.

BACKGROUND ART

Thin-walled curved surface parts are used as key components in vehicles such as rockets, aircrafts, high-speed trains and automobiles. The geometry, dimensional accuracy and overall performance of such a part (e.g., a fuel tank dome for a launch vehicle, an aircraft envelope, an automobile panel) have direct influence on the aerodynamic performance, carrying capacity, payload and service life of the vehicle. To meet the increasingly higher requirements of the new generation of launch vehicles in terms of light weight and high reliability, there is an urgent need for a high-performance integrated thin-walled structure to replace the existing multi-piece tailor-welded structure. The integration of a thin-walled curved surface part results in more complex shape and a larger size thereof. For the sake of light weight, it is necessary to use a high-strength lightweight alloy material, which renders the forming of such a thin-walled curved surface part more difficult.

Taking a fuel tank dome for example, duel to an ultra-thin wall (with a thickness-to-diameter ratio of less than 3‰) and poor room-temperature ductility of the used high-strength aluminum alloy, the problems of wrinkling and cracking of such a thin-walled curved surface part during its integrated forming cannot be solved in the prior art. In recent years, an advanced super cryogenic forming technique has been developed, which allows an aluminum alloy thin-walled curved surface part to be formed with a die at an ultra-low temperature (below −160° C.), based on significantly improved formability of the aluminum alloy at an ultra-low temperature. The technique can significantly increase the forming limit and overcome the problem of cracking and can feasibly provide increased blank holder force to prevent wrinkling.

Super cryogenic forming is a completely new forming manufacturing technique, in which the key is how to realize the deformation of the blank at an ultra-low temperature. Current research on this technique is still at a preliminary stage on an international scale and there is no mature experience that can be used for reference. During the research on the principle of the super cryogenic forming technique, to achieve uniform cooling, the die is completely immersed in a super cryogenic medium, which results in a series of problems including high consumption of the super cryogenic medium, difficult of batch production, impossible forming of large-size components, etc. Alternatively, the forming tool is placed in a cryogenic box. However, the blank cannot be cooled to a low temperature in this way.

SUMMARY

An objective of the present disclosure is to provide a device for super cryogenic forming of a metal thin-walled curved surface part to address the problems in the prior art, such that the super cryogenic forming of a metal thin-walled curved surface part can be realized with a super cryogenic medium to directly cool both forming die and blank.

To achieve the above objective, the present disclosure provides the following solutions:

The present disclosure provides a device for super cryogenic forming of a metal thin-walled curved surface part, including a super cryogenic medium conveying and pressurizing unit, a press, a die unit and a control system, where blank holder cylinder, a blank holder slide, a deep drawing cylinder and a deep drawing slide are disposed on the press; the blank holder cylinder is capable of driving the blank holder slide to move up and down vertically and the deep drawing cylinder is capable of driving the deep drawing slide to move up and down vertically; the die unit includes a male die fixedly connected to a bottom end of the deep drawing slide, a blank holder fixedly connected to a bottom end of the blank holder slide, and a female die fixedly connected to the moving platform in the press, with the male die directly facing the female die and being coaxial with the blank holder; the super cryogenic medium conveying and pressurizing unit includes an autoboosting cryogenic container; a cryogenic channel in the blank holder, a cryogenic channel in the female die and a cavity of the female die are communicated with an outlet of the autoboosting cryogenic container by cryogenic pipes, respectively; a cryogenic pump is disposed on the cryogenic pipe between the cavity of the female die and the autoboosting cryogenic container; temperature sensors are disposed in sidewalls of the female die and the blank holder, respectively; a pressure sensor is disposed in the cavity of the female die; and the deep drawing cylinder, the blank holder cylinder, the autoboosting cryogenic container, the cryogenic pump, the temperature sensors and the pressure sensor are each electrically connected to the control system.

Preferably, cryogenic valves which are electrically connected to the control system are disposed on the cryogenic pipe between the cryogenic channel in the blank holder and the autoboosting cryogenic container and the cryogenic pipe between the cryogenic channel in the female die and the autoboosting cryogenic container, respectively.

Preferably, the autoboosting cryogenic container contains a super cryogenic medium which is liquid argon, liquid nitrogen, or liquid helium.

Preferably, the blank is cooled to a set temperature ranging from −270° C. to −160° C. directly with the super cryogenic medium or indirectly by means of cooling of the die.

Preferably, during the cooling of the die, the opening of each cryogenic valve is adjusted in real time based on the temperature and pressure of the super cryogenic medium at an outlet of the die, as well as a die temperature; to realize accurate control on the die temperature; and the die is cooled to a temperature ranging from −270° C. to 0° C.

Preferably, quick creation of pressure of large volume super cryogenic medium is realized by rapidly filling the cavity of the female die with the super cryogenic medium from the autoboosting cryogenic container and then increasing the pressure of the super cryogenic medium to a set pressure range of 0.8-30 MPa by means of the cryogenic pump.

Preferably, heat insulating plates are sandwiched between the male die and the deep drawing module, the female die and the moving platform, and the blank holder and the blank holder slide, respectively.

Preferably, the press includes an upper cross beam, a lower cross beam, the moving platform, a hydraulic electrical system, and four pull rods; two ends of each pull rod extend through the upper cross beam and the lower cross beam, respectively, and four nuts are in threaded connection with the pull rod, with two nuts located on two sides of the upper cross beam and abutting on the upper cross beam and the other two nuts located on two sides of the lower cross beam and abutting on the lower cross beam; the four pull rods are distributed tetragonally; the moving platform is disposed on the lower cross beam; and the deep drawing cylinder and the blank holder cylinder are each electrically connected to the hydraulic electrical system.

Preferably, each of the pull rods is sleeved with a column which is vertically secured between the upper cross beam and the lower cross beam; the moving platform is disposed on the lower cross beam; and a guide structure with four corners and eight faces is formed by each of the blank holder slide and the deep drawing slide in combination with the four columns.

Preferably, the control system includes a programmable logical controller (PLC), a signal input module, a communication module, a signal output module and a touch screen; the signal input module, the communication module, the signal output module and the touch screen are each electrically connected to the PLC; the press, the autoboosting cryogenic container, the cryogenic valves and the cryogenic booster pump are each electrically connected to the signal output module; the temperature sensors and the pressure sensor are each electrically connected to the signal input module.

The present disclosure has the following advantages over the prior art.

The device for super cryogenic forming of a metal thin-walled curved surface part in the present disclosure can realize super cryogenic forming of a metal thin-walled curved surface part with a super cryogenic medium to directly cool the blank. According to the present disclosure, the device for super cryogenic forming of a metal thin-walled curved surface part can realize highly efficient cooling of the blank with the pressurized super cryogenic medium and allow the blank to deform at an ultra-low temperature with a significantly increased forming limit. The device for super cryogenic forming of a metal thin-walled curved surface part permits direct cooling of the blank with the super cryogenic medium to address the problem of difficult cooling of a large-size die. The device for super cryogenic forming of a metal thin-walled curved surface part allows for closed-loop control on the conveying flow of the super cryogenic medium, facilitating accurate control on the die temperature. Moreover, the device for super cryogenic forming of a metal thin-walled curved surface part also permits rapid large-flow low-pressure filling and pressurizing by means of the cryogenic pump, facilitating quick creation of quick creation of pressure of large volume super cryogenic medium. In the device for super cryogenic forming of a metal thin-walled curved surface part, each of units thereof has an independent electro-hydraulic system that can independently support the operation of the corresponding unit. Industrial production can be realized by combining modular assembly with integrated control via network communication.

BRIEF DESCRIPTION OF THE DRAWINGS

To explain the technical solutions in embodiments of the present disclosure or in the prior art more clearly, the accompanying drawings required for the embodiments will be briefly described below. Apparently, the accompanying drawings described below are merely some embodiments of the present disclosure, and other accompanying drawings may be derived from these drawings by a person of ordinary skill in the art without creative efforts.

Figure 1:
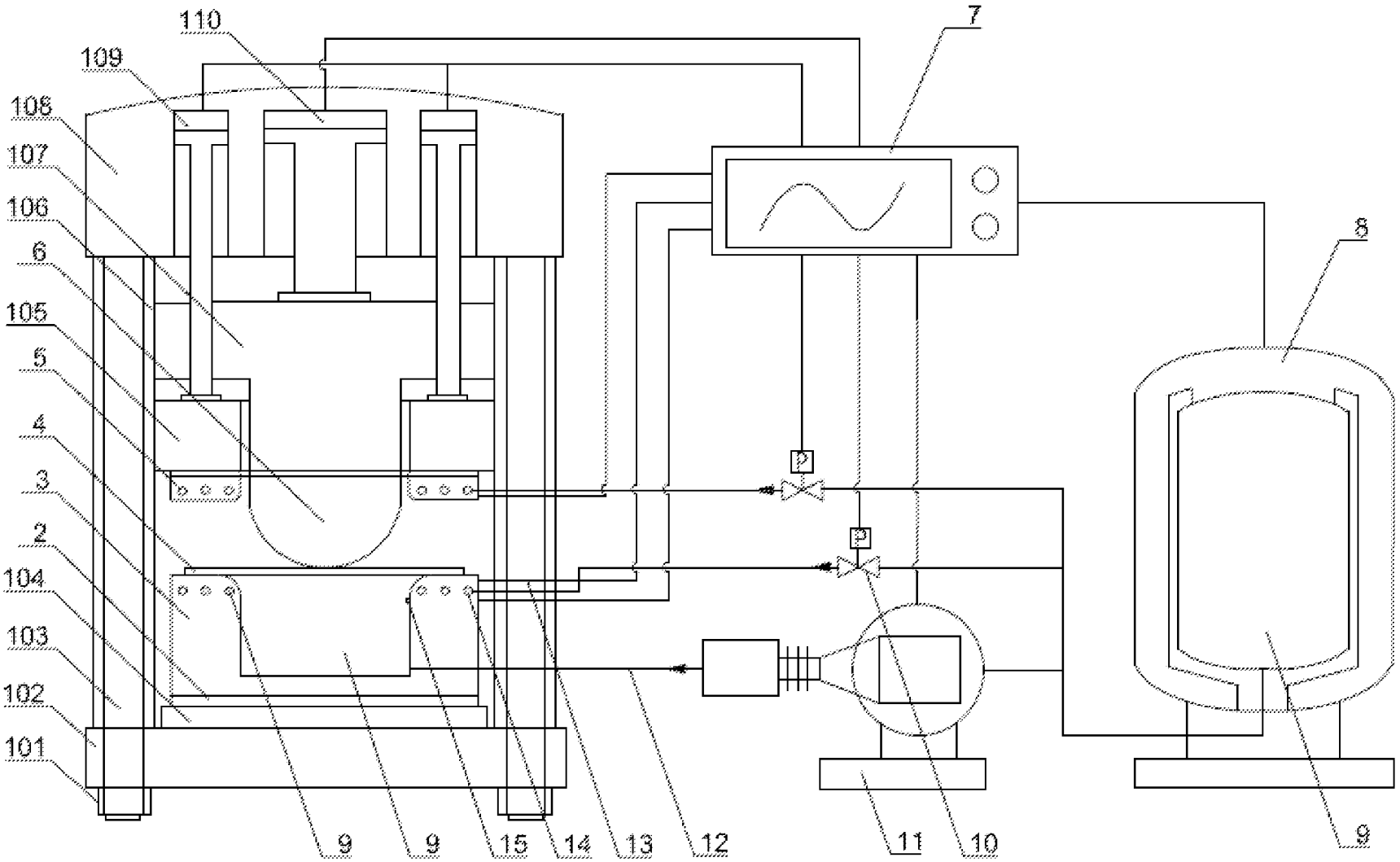
FIG. 1 is a structural schematic diagram of a device for super cryogenic forming of a metal thin-walled curved surface part according to an embodiment of the present disclosure.

List of reference numerals: 1, press; 101, nut; 102, lower cross beam; 103, pull rod; 104, moving platform; 105, blank holder slide; 106, column; 107, deep drawing slide; 108, upper cross beam; 109, blank holder cylinder; 110, deep drawing cylinder; 2, heat insulating plate; 3, female die; 4, blank; 5, blank holder; 6, male die; 7, control system; 8, autoboosting cryogenic container; 9, super cryogenic medium; 10, cryogenic valve; 11, cryogenic pump; 12, cryogenic pipe; 13, temperature sensor; 14, cryogenic channel; 15, pressure sensor; 16. control software; 17, touch screen; 18, signal input module; 19, programmable logic controller (PLC); 20, signal output module; 21, displacement sensor for deep drawing slide; 22, pressure sensor for deep drawing cylinder; 23, displacement sensor for blank holder slide; 24, pressure sensor for blank holder cylinder; 25, die temperature sensor; 26, pipe temperature sensor; 27, blank temperature sensor; 28, pressure sensor for female die cavity; and 29, press electro-hydraulic system.

DETAILED DESCRIPTION OF THE EMBODIMENTS

The technical solutions in the embodiments of the present disclosure will be described below clearly and completely with reference to the accompanying drawings used therein. Apparently, the described embodiments are merely a part rather than all of the embodiments of the present disclosure. All other embodiments derived from the embodiments in the present disclosure by a person of ordinary skill in the art without creative efforts shall fall within the protection scope of the present disclosure.

An objective of the present disclosure is to provide a device for super cryogenic forming of a metal thin-walled curved surface part to address the problems in the prior art, such that the super cryogenic forming of a metal thin-walled curved surface part can be realized with a super cryogenic medium to directly cool both forming die and blank.

To make the above-mentioned objectives, features, and advantages of the present disclosure clearer and more comprehensible, the present disclosure will be further described in detail below in conjunction with the accompanying drawings and specific embodiments.

Figure 2:
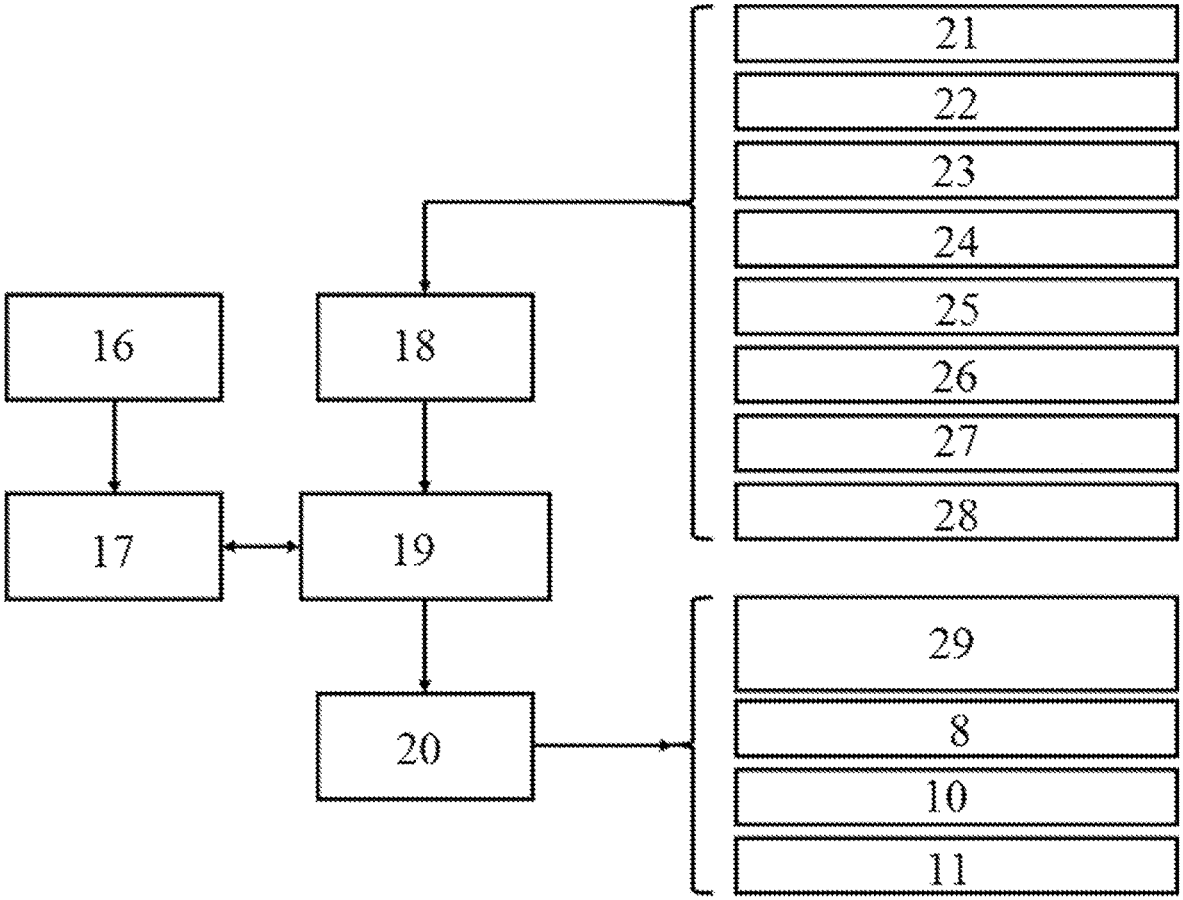
FIG. 2 is a schematic diagram of a control system in a device for super cryogenic forming of a metal thin-walled curved surface part according to an embodiment of the present disclosure.

As shown in FIG. 1 to FIG. 2, an embodiment provides a device for super cryogenic forming of a metal thin-walled curved surface part, including a super cryogenic medium conveying and pressurizing unit, a press 1, a die unit and a control system 7. The control system 7 mainly includes a control component, a signal collecting system, an output transformation system, an actuating element, control software 16, etc., which are configured to perform the collection of signals to and the transmission of commands from the joint control system.

The press 1 includes an upper cross beam 108, a lower cross beam 102, a moving platform 104, a hydraulic electrical system, and four pull rods 103. Two ends of each pull rod 103 extend through the upper cross beam 108 and the lower cross beam 102, respectively, and four nuts are in threaded connection with the pull rod 103, with two nuts located on two sides of the upper cross beam 108 and abutting on the upper cross beam 108 and the other two nuts located on two sides of the lower cross beam 102 and abutting on the lower cross beam 102. The four pull rods 103 are distributed tetragonally. The moving platform 104 is disposed on the lower cross beam 102. Each pull rod 103 is sleeved with a column 106 which is vertically secured between the upper cross beam 108 and the lower cross beam 102. The moving platform 104 is disposed on the lower cross beam 102. A guide structure with four corners and eight faces is formed by each of a blank holder slide 105 and a deep drawing slide 107 in combination with the four columns 106. A deep drawing cylinder 110 and a blank holder cylinder 109 are each connected to the hydraulic electrical system. The hydraulic electrical system is configured to provide the press 1 with power to realize specific control and execution of each movement thereof. The hydraulic electrical system is electrically connected to the control system 7. In this embodiment, the press 1 may also have a double-acting four-column structure, which is conducive to reducing the manufacturing cost of the device for super cryogenic forming.

The blank holder cylinder 109, the blank holder slide 105, the deep drawing cylinder 110 and the deep drawing slide 107 are disclosed on the press 1. The blank holder cylinder 109 is capable of driving the blank holder slide 105 to move up and down vertically and the deep drawing cylinder 110 is capable of driving the deep drawing slide 107 to move up and down vertically. Both of the blank holder cylinder 109 and the deep drawing cylinder 110 are arranged on the upper cross beam 108. The blank holder slide 105 and the deep drawing slide 107 each have an upper-lower structure or an inside-outside structure. A guide structure with four corners and eight faces is formed by each of the blank holder slide 105 and the deep drawing slide 107 in combination with the four columns 106. A pressure sensor and a displacement sensor are mounted on the blank holder cylinder 109 and the deep drawing cylinder 110, respectively, to collect in real time pressure and displacement signals that are fed back to the control system 7, helping the control system 7 to control the movements of the blank holder slide 105 and the deep drawing slide 107. The die unit includes a male die 6 fixedly connected to the bottom end of the deep drawing slide 107, a blank holder 5 fixedly connected to the bottom end of the blank holder slide 105, and a female die 3 fixedly connected to the moving platform 104 in the press 1, with the male die 6 directly facing the female die 3 and being coaxial with the blank holder 5. Heat insulating plates 2 are sandwiched between the male die 6 and the deep drawing module, the female die 3 and the moving platform 104, and the blank holder 5 and the blank holder slide 105, respectively. The heat insulating plates 2 can prevent the die at a low temperature from absorbing heat. The profile of the male die 6 may also be subjected to heat insulation treatment when necessary, whereby the influence of the male die 6 on the temperature of the blank in contact with the same can be avoided. Alternatively, the male die 6, the female die 3 and the blank holder 5 may also be connected indirectly by means of a die carrier, thereby facilitating coordination of different members with one another.

The super cryogenic medium conveying and pressurizing unit includes an autoboosting cryogenic container 8. A cryogenic channel 14 in the blank holder 5, a cryogenic channel 14 in the female die 3 and the cavity of the female die 3 are communicated with the outlet of the autoboosting cryogenic container 8 by cryogenic pipes, respectively. A cryogenic pump 11 is disposed on the cryogenic pipe between the cavity of the female die 3 and the autoboosting cryogenic container 8. Temperature sensors 13 are disposed in sidewalls of the female die 3 and the blank holder 5, respectively. A pressure sensor 15 is disposed in the cavity of the female die 3. The autoboosting cryogenic container 8 contains a super cryogenic medium 9 which is liquid argon, liquid nitrogen, or liquid helium. The autoboosting cryogenic container 8 is configured to store the super cryogenic medium 9 and can realize self-boosting by evaporation of the super cryogenic medium 9 with a general pressure range of 0.02 MPa to 1.6 MPa. The cryogenic pipes 12 are configured to connect the autoboosting cryogenic container 8, cryogenic valves 10, the cryogenic pump 11 and the die so as to convey the super cryogenic medium 9 to the die and the cavity thereof. The cryogenic valves 10 are configured to control the conveying of the super cryogenic medium 9. Specifically, the conveying flow of the medium is adjusted by proportionally adjusting the opening of each valve. The cryogenic pump 11 is configured to pressurize the super cryogenic medium 9 in the cavity of the female die 3 with a pressure generally ranging from 0.8 MPa to 30 MPa.

The deep drawing cylinder 110, the blank holder cylinder 109, the autoboosting cryogenic container 8, the cryogenic pump 11, the temperature sensors 13 and the pressure sensor 15 are each electrically connected to the control system 7. The cryogenic valves 10 which are electrically connected to the control system 7 are disposed on the cryogenic pipe between the cryogenic channel 14 in the blank holder 5 and the autoboosting cryogenic container 8 and the cryogenic pipe between the cryogenic channel 14 in the female die 3 and the autoboosting cryogenic container 8, respectively. The control system 7 is configured for integrated control on the press 1 and the super cryogenic medium conveying and pressurizing unit to realize cooperative control on die temperature, medium temperature, pressure, blank holder force and deep drawing displacement.

With reference to FIG. 2, in the device for super cryogenic forming of a metal thin-walled curved surface part in this embodiment, each of units thereof has an independent electro-hydraulic system that can independently support the operation of the corresponding unit. A safe-type programmable logical controller (PLC) 19 is used as a control center. A touch screen 17, a signal input module 18, and a signal output module 20 are respectively electrically connected to the PLC 19. The PLC 19 is provided with control software 16, and the control software 16 can be controlled through the touch screen 17. A displacement sensor 21 for deep drawing slide, a pressure sensor 22 for deep drawing cylinder, a displacement sensor 23 for blank holder slide, a pressure sensor 24 for blank holder cylinder, a die temperature sensor 25, a pipe temperature sensor 26, a blank temperature sensor 27 and a pressure sensor 28 for female die cavity are respectively electrically connected with the signal input module 18. A press electro-hydraulic system 29, the autoboosting cryogenic container 8, the cryogenic valve 10, and the cryogenic pump 11 are electrically connected to the signal output module 20, respectively.

The specific model of the PLC 19 is SIEMENS PLC (CPU1515). The PLC 19 is electrically connected to a ProfiNet communication module which is connected to a network by means of a router to realize integrated control on a touch screen 17. ProfiNet controls each unit to realize integrated control, and this process is characterized by fast signal response and high anti-jamming capability. Industrial production can be realized by combining modular assembly with integrated control via network communication.

During the operating process of the device for super cryogenic forming of a metal thin-walled curved surface part in this embodiment, the super cryogenic medium is selectively injected into the female die 3, the blank holder 5 and the cavity of the female die 3 by the super cryogenic medium conveying and pressurizing unit according to the deformation requirement of the blank 4 to cool and pressurize the blank 4, thereby realizing super cryogenic forming. Uniform or partitioned cooling of the blank 4 is realized by a combination of indirect cooling by cooling of the die and direct cooling with the super cryogenic medium 9. The blank 4 in a forming zone is cooled to a temperature ranging from −270° C. to −120° C. During the cooling of the die, the opening of each cryogenic valve 10 is adjusted in real time based on the temperature and pressure of the super cryogenic medium 9 at the outlet of the die, as well as a die temperature; to realize accurate control on the die temperature. The die is cooled to a temperature ranging from −270° C. to 0° C.

When pressurizing the super cryogenic medium 9 in the cavity of the female die 3, quick creation of pressure of large volume super cryogenic medium 9 is realized by rapidly filling the cavity of the female die 3 with the super cryogenic medium from the autoboosting cryogenic container 8 and then increasing the pressure of the super cryogenic medium 9 by means of the cryogenic pump 11.

The device for super cryogenic forming provided in the present disclosure permits modular assembly and integrated control via network communication. The device for super cryogenic forming provided in the present disclosure can be useful for super cryogenic forming of aluminum, magnesium or titanium alloys.

In the description of the present disclosure, it should be noted that orientations or positional relationships indicated by the terms "top", "bottom", "vertical", "horizontal", etc. are all based on what are illustrated in the drawings, and such terms are used herein for ease and simplification of description of the disclosure rather than indicating or implying that the stated device or element must have a specific orientation or must be constructed and operated in a specific orientation, and thus cannot be construed as limitations to the disclosure.

Specific examples are used in this description for illustration of the principles and embodiments of the present disclosure. The foregoing description is just meant to help understand the method of the present disclosure and its core idea. In addition, various modifications can be made by a person skilled in the art to the specific embodiments and the application scope in accordance with the idea of the present disclosure. In conclusion, the contents of this description should not be construed as limitations to the present disclosure.

What is claimed is:

1. A device for super cryogenic forming of a metal thin-walled curved surface part, the device comprising a super cryogenic medium conveying and pressurizing unit, a press, a die unit and a control system, wherein the press comprises a blank holder cylinder, a blank holder slide, a deep drawing cylinder and a deep drawing slide that are disposed on the press; the blank holder cylinder is capable of driving the blank holder slide to move up and down vertically and the deep drawing cylinder is capable of driving the deep drawing slide to move up and down vertically; the die unit comprises a male die fixedly connected to a bottom end of the deep drawing slide, a blank holder fixedly connected to a bottom end of the blank holder slide, and a female die fixedly connected to a moving platform in the press, with the male die directly facing the female die and being coaxial with the blank holder; the super cryogenic medium conveying and pressurizing unit comprises an autoboosting cryogenic container; a cryogenic channel of the blank holder, a cryogenic channel of the female die and a cavity of the female die communicate with an outlet of the autoboosting cryogenic container by cryogenic pipes of the device, respectively; a cryogenic pump of the device is disposed on first ones of the cryogenic pipes between the cavity of the female die and the autoboosting cryogenic container; the female die and the blank holder comprise temperature sensors that are disposed in sidewalls of the female die and the blank holder, respectively; the female die comprises a pressure sensor that is disposed in the cavity of the female die; and the deep drawing cylinder, the blank holder cylinder, the autoboosting cryogenic container, the cryogenic pump, the temperature sensors and the pressure sensor are each electrically connected to the control system;

wherein the autoboosting cryogenic container contains a super cryogenic medium, the control system is configured to control the cavity of the female die to be filled with the super cryogenic medium from the autoboosting cryogenic container, and the control system is configured to control the cryogenic pump to set pressure of the super cryogenic medium to a range of 0.8-30 MPa, so that any volume filling of the super cryogenic medium under pressure is realized, allowing for an increased cooling rate of a blank;

wherein cryogenic valves which are electrically connected to the control system are disposed on second ones of the cryogenic pipes between the cryogenic channel in the blank holder and the autoboosting cryogenic container and the first ones of the cryogenic pipes between the cryogenic channel in the female die and the autoboosting cryogenic container, respectively;

wherein the control system comprises a programmable logical controller (PLC), a signal input module, a communication module, a signal output module and a touch screen; the signal input module, the communication module, the signal output module and the touch screen are each electrically connected to the PLC; the press, the autoboosting cryogenic container, the cryogenic valves and the cryogenic pump are each electrically connected to the signal output module; displacement sensors are disposed on the blank holder cylinder and the deep drawing cylinder, respectively; the displacement sensors, the temperature sensors and the pressure sensor are each electrically connected to the signal input module;

wherein the blank holder is configured to hold the blank in a position such that the super cryogenic medium directly cools the blank or the female die indirectly cools the blank to a set temperature ranging from −270° C. to −120° C.;

wherein the control system is configured such that during cooling of the female die, opening of each cryogenic valve is adjusted by the control system in real time based on a temperature and the pressure of the super cryogenic medium at an outlet of the female die, as well as a female die temperature, so as to realize accurate control on the female die temperature; and to cool the female die to a temperature ranging from −270° C. to 0° C.

2. The device for super cryogenic forming of a metal thin-walled curved surface part according to claim 1, wherein the super cryogenic medium is liquid argon, liquid nitrogen, or liquid helium.

3. The device for super cryogenic forming of a metal thin-walled curved surface part according to claim 1, wherein the device further comprising a plurality of heat insulating plates, at least one of the plurality of heat insulating plates is sandwiched between the male die and the deep drawing slide, at least one of the plurality of heat insulating plates is sandwiched between the female die and the moving platform, and at least one of the plurality of heat insulating plates is sandwiched between the blank holder and the blank holder slide.

4. The device for super cryogenic forming of a metal thin-walled curved surface part according to claim 1, wherein the press comprises an upper cross beam, a lower cross beam, the moving platform, a hydraulic electrical system, and four pull rods; each of the four pull rods includes a top end extending through the upper cross beam and a lower end extending through the lower cross beam, and wherein each of the four pull rods includes four nuts with two nuts on either side of the upper cross beam and other two nuts on either side of the lower cross beam; the four pull rods are distributed tetragonally; the moving platform is disposed on the lower cross beam; and the deep drawing cylinder and the blank holder cylinder are each electrically connected to the hydraulic electrical system.

5. The device for super cryogenic forming of a metal thin-walled curved surface part according to claim 4, wherein each of the pull rods is sleeved with a column which is vertically secured between the upper cross beam and the lower cross beam; and a guide structure with four corners and eight faces is formed by each of the blank holder slide and the deep drawing slide in combination with the four columns.

* * * * *